US005954913A

United States Patent [19]

Wurz et al.

[11] Patent Number: 5,954,913

[45] Date of Patent: Sep. 21, 1999

[54] LABEL APPLICATOR

[75] Inventors: Albert Wurz, Doylestown; Edward P. Yeh, Harleysville; Thomas J. Brobst, Allentown, all of Pa.

[73] Assignee: Accu-Sort Systems, Inc., Telford, Pa.

[21] Appl. No.: 08/995,892

[22] Filed: Dec. 22, 1997

Related U.S. Application Data

[63] Continuation-in-part of application No. 08/479,368, Jun. 7, 1995, Pat. No. 5,705,021, which is a continuation-in-part of application No. 08/235,157, Apr. 29, 1994, abandoned.

[51] Int. Cl.[6] ..... B65C 9/00

[52] U.S. Cl. ..... 156/360; 156/361; 156/363; 156/543

[58] Field of Search ..... 156/352, 360, 156/361, 363, 364, 495, 541, 542

[56] References Cited

U.S. PATENT DOCUMENTS

| | | | |
|---|---|---|---|
| Re. 30,419 | 10/1980 | Crankshaw et al. | 156/249 |
| 2,535,240 | 12/1950 | Spiller et al. | 164/48 |
| 3,232,815 | 2/1966 | Klopfenstein et al. | 156/360 |
| 3,329,550 | 7/1967 | Kucheck | 156/285 |
| 3,372,079 | 3/1968 | Fellner et al. | 156/360 |
| 3,607,547 | 9/1971 | Kronseder | 156/351 |
| 3,729,362 | 4/1973 | French et al. | 156/542 |
| 3,772,120 | 11/1973 | Radzins | 156/521 X |
| 3,923,199 | 12/1975 | Real | 156/541 X |
| 4,017,350 | 4/1977 | Thomas | 156/384 |
| 4,046,613 | 9/1977 | Kucheck et al. | 156/249 |
| 4,089,725 | 5/1978 | Crankshaw et al. | 156/299 |
| 4,124,429 | 11/1978 | Crankshaw | 156/364 |
| 4,201,621 | 5/1980 | Crankshaw et al. | 156/567 |
| 4,210,484 | 7/1980 | Crankshaw et al. | 156/542 |
| 4,255,220 | 3/1981 | Kucheck et al. | 156/285 |
| 4,267,004 | 5/1981 | Anderson | 156/361 |
| 4,276,112 | 6/1981 | French et al. | 156/360 |
| 4,314,869 | 2/1982 | Crankshaw | 156/215 |
| 4,321,103 | 3/1982 | Lindstrom et al. | 156/351 |
| 4,337,108 | 6/1982 | Crankshaw et al. | 156/285 |
| 4,349,405 | 9/1982 | Dudzik | 156/358 |
| 4,390,386 | 6/1983 | Bartl | 156/235 |
| 4,400,230 | 8/1983 | Wyslotsky | 156/361 |
| 4,473,429 | 9/1984 | Crankshaw | 156/483 |

(List continued on next page.)

FOREIGN PATENT DOCUMENTS

| | | | |
|---|---|---|---|
| 0460281 | 12/1991 | European Pat. Off. | B65C 11/02 |
| 0476447 | 3/1992 | European Pat. Off. | B65C 9/18 |
| 2464195 | 5/1979 | France | B65C 9/26 |
| 8803034 | 5/1988 | Germany . | |
| 91078989 | 9/1991 | Germany | B65C 9/08 |
| 2076549 | 12/1981 | United Kingdom . | |
| 2092095 | 11/1982 | United Kingdom | B65C 9/18 |
| WO9301094 | 1/1993 | WIPO | B65C 9/18 |
| WO9308081 | 4/1993 | WIPO | B65C 9/18 |
| WO9323292 | 11/1993 | WIPO | B65C 9/42 |

*Primary Examiner*—James Engel
*Attorney, Agent, or Firm*—Volpe and Koenig, P.C.

[57] ABSTRACT

A label applicator for applying a label to the top surface of an object moving along a path adjacent to the applicator. The applicator is comprised of a label printer mounted for vertical adjustment on support structure attached to a fixed frame. The printer has a label feed position and is adjusted vertically on the support to set the label feed position to an expected median article height. A label transport assembly, attached to the frame, receives and retains the label and then moves vertically and laterally from a home position, above the label feed position, to an article intercept position, where it applies the label to the moving article. The controller learns the home position and positions the label transport assembly at the home position to pick up labels. The label printer, the label transport assembly, and the moveable frame are located alongside the object path such that when the label transport assembly is in the home position, the object path is vertically unobstructed.

6 Claims, 3 Drawing Sheets

U.S. PATENT DOCUMENTS

| | | | |
|---|---|---|---|
| 4,475,978 | 10/1984 | Bartl | 156/497 |
| 4,566,933 | 1/1986 | Crankshaw et al. | 156/444 |
| 4,585,504 | 4/1986 | Marchetti | 156/351 |
| 4,612,078 | 9/1986 | Karp | 156/493 |
| 4,612,079 | 9/1986 | Ostrow | 156/497 |
| 4,615,757 | 10/1986 | Treiber | 156/350 |
| 4,707,211 | 11/1987 | Shibata | 156/354 |
| 4,830,701 | 5/1989 | Crankshaw et al. | 156/448 |
| 4,842,660 | 6/1989 | Voltmer et al. | 156/94 |
| 4,844,771 | 7/1989 | Crankshaw et al. | 156/387 |
| 4,857,121 | 8/1989 | Markley et al. | 156/64 |
| 5,078,816 | 1/1992 | Ratermann | 156/64 |
| 5,133,827 | 7/1992 | Ratermann | 156/361 |
| 5,188,687 | 2/1993 | Baum | 156/64 |
| 5,232,539 | 8/1993 | Carpenter et al. | 156/360 |
| 5,660,676 | 8/1997 | Brooks | 156/361 |

LABEL APPLICATOR

This application is a continuation-in-part of U.S. application Ser. No. 08/479,368, filed Jun 7, 1995, now U.S. Pat. No. 5,705,021, which is a continuation-in-part of U.S. application Ser. No. 08/235,157, filed Apr. 29, 1994, now abandoned.

BACKGROUND OF THE INVENTION

1. Field of the Invention

The present invention is generally directed to a label applicator which applies a label to an article moving along a known travel path. More particularly, the present invention relates to a label applicator which is used to apply shipping labels to articles being transported on a conveyor system. Most particularly, the label applicator of the present invention finds use in the application of shipping labels to tops of articles of varying heights being carried on high throughput conveyor systems.

2. Description of the Prior Art

The use of automated labeling equipment for applying labels to moving, conveyor borne articles is known in the art. In one known system, the label is first printed with various label information by a label printer and the printed label is presented at the feed position where it is then retained against a grid by means of a vacuum. When the object to be labeled is moved into alignment with the label applicator, a blast of gas transfers the label to the article. One such prior art arrangement is shown in U.S. Pat. No. 3,329,550, which issued on Jul. 4, 1967.

However, when labels are to be applied to the top surfaces of packages of varying heights it is desirable to move the label retaining grid into closer proximity to the surface of the article to be labeled. One prior art device teaches the use of a plurality of hollow vacuum fingers which transfer a label to a surface and apply it by contact with the surface or with an air blast. This arrangement is disclosed in U.S. Pat. No. 4,729,362, which issued on Apr. 24, 1973. While this arrangement is satisfactory in some applications, it does not accommodate large variances in article heights.

Other label applicators, such as that disclosed by U.S. Pat. No. 4,615,757, which issued on Oct. 7, 1986, utilize a label printer mounted for horizontal movement above the conveyor with a gravity biased label applying arm which drops into contact with the article to apply the label. U.S. Pat. No. 5,232,539 discloses a movable printer/applicator head which is mounted over a conveyor and travels vertically along a fixed path to apply labels to articles of different heights.

In all of the prior art label applicators for applying labels to the tops of articles, the label printer and/or applicator are suspended above the conveyor path. This necessitates special handling for oversized packages which cannot pass beneath the labeling equipment. Additionally, the prior art label applicators which are mounted above the conveyor for top labeling of articles must travel from the label printer, which is located at a point above the maximum package height, down to the top surface of the package to apply the label, and then return to the printer for the next label. In systems where the label printer is combined with the applicator and is moved, either horizontally or vertically, into proximity with the package surface to be labeled, moving the mass of the label printer itself up and down to accommodate the various package heights requires heavy duty equipment for rapidly accelerating and decelerating the entire printer/applicator mass in high throughput applications.

Additionally, most of the prior art label printer/applicator assemblies use label stock wound on a supply reel and the spent backing strip is wound onto a take-up reel. The quantity of labels is limited by the size of the supply reel which can be accommodated by the equipment. Each time the supply reel runs out of stock, a new reel of label stock must be installed and threaded through the printer. The reels of spent backing paper must also be periodically removed.

Preferably, to maintain a high throughput of articles on the conveyor, the time between the time the application of labels on successively appearing products of different heights will be less than 1.0 seconds. Down time for adding new label stock must also be minimized.

SUMMARY OF THE INVENTION

The present invention provides a label applicator for applying a label to an article in motion along a given path. The label applicator has a label printer mounted for vertical adjustment on a support means attached to a fixed frame. The printer has a home, label feed position and is adjusted vertically on the support means to set the label feed position to an expected median article height. An articulated label transport means, attached to the frame, learns the home position, receives and retains the label and then moves to an article intercept position, where it applies the label to the moving article. The label printer, the label transport means, and the fixed frame are located alongside the object path such that when the label transport means is in the home position, the object path is vertically unobstructed.

It is an object of this invention to provide a label applicator for labeling articles on a high throughput conveyor system.

It is an object of this invention to provide a label applicator which, in the home position, leaves the article path vertically unobstructed.

It is an object of this invention to provide a label applicator in which the label printer is adjustable to an expected median article height and the label applicator learns the home position.

DESCRIPTION OF THE PREFERRED EMBODIMENT

Figure 1:
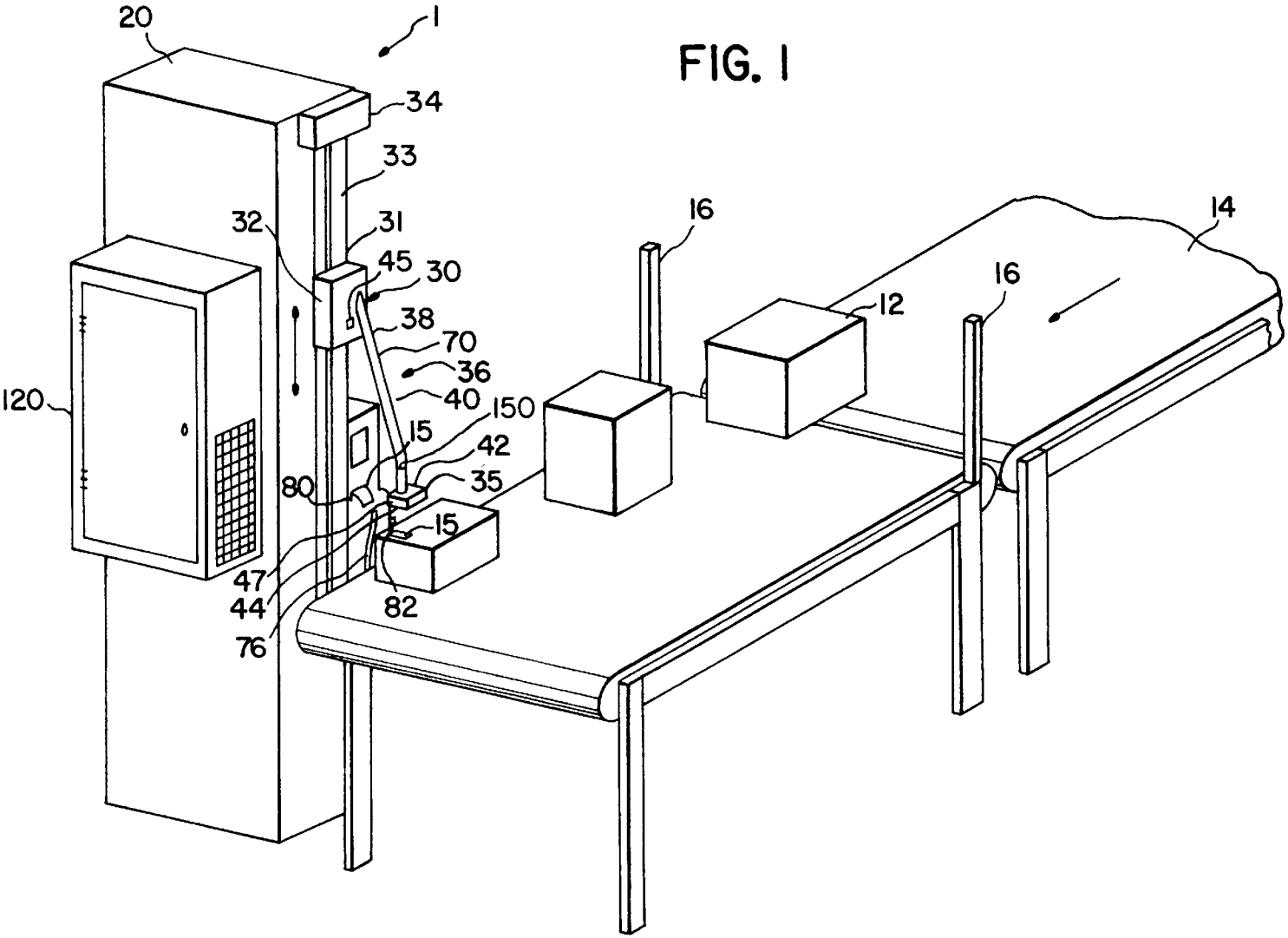
FIG. 1 is a perspective view of a label applicator in accordance with the present invention.

In FIG. 1, label applicator 1 in accordance with the present invention is shown positioned adjacent to a conveyor 14. Preferably, articles 12 are aligned with the label applicator side of the conveyor 14 and are moved by the conveyor in the indicated direction past a plurality of sensors which detect the article height and position data. As the article passes the label applicator 1, a label 15 is placed on the top article surface.

Figure 2:
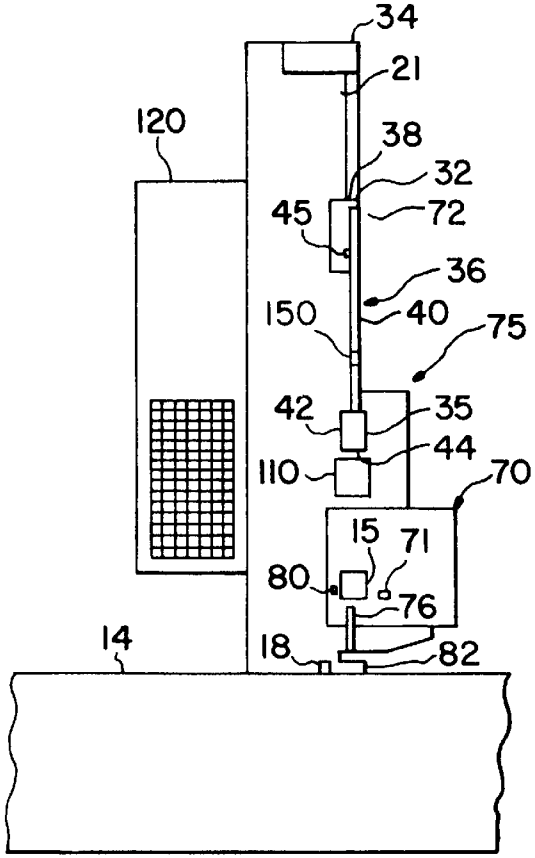
FIG. 2 is a front view of the preferred embodiment.

As shown in FIGS. 1 and 2, label applicator 1 is comprised of a column 20 which supports the applicator assembly 30, the controller 120 and an enclosure 75 which includes the printer 70 and disposal assembly 110.

The applicator assembly 30 is comprised of a vertical actuator 31 which is mounted to column 20 adjacent to the conveyor 14. The vertical actuator 31 is driven by a servomotor 34 to vertically displace carriage 32 attached to the actuator 31. In the preferred embodiment, the vertical actuator 31 is a Macron Dynamics 6MM Linear Actuator.

A label transport assembly 36 is attached to the carriage 32. The transport assembly 36 has a rotary actuator 38 which is mounted on the carriage 32. The rotary actuator 38 moves a swing arm 40 between retracted and extended positions. A vacuum/blow plate 42 is attached to the swing arm 40. The vacuum/blow plate 42 has a plurality of apertures, as shown in FIG. 4, which provides a vacuum source or air pressure source as is known in the art.

Figure 6:
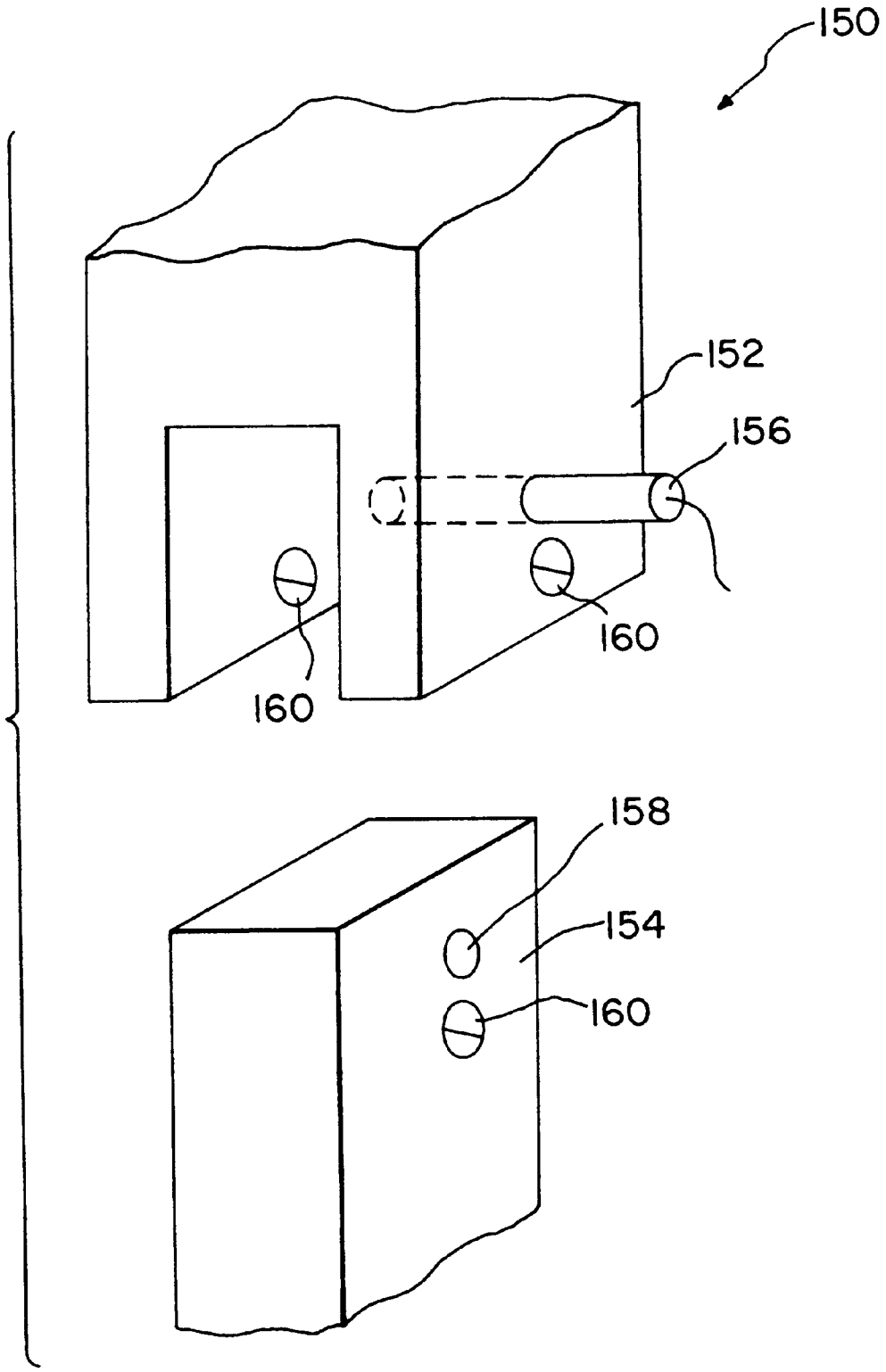
FIG. 6 is a perspective view of the swing arm breakaway joint.

As shown in FIG. 6, the swing arm 40 has a lower member 154 which connects with an upper member 152 at a breakaway joint 150. The mating relationship of the upper and lower members 152 and 154 may be reversed or other connecting means, as known in the art may be utilized. The breakaway joint 150 helps prevent damage to the arm 40 it if is struck by a moving object. The upper and lower members 152 and 154 are preferably joined in a semi-rigid, pivotable relationship by a bolt which passes through an aperture 160 that extends through the upper and lower members 152 and 154. By semi-rigid, it is meant that the upper and lower members 152 and 154 generally move as a rigid unit, with the members 152 and 154 in a given alignment, but pivot relative to one another if a force is applied against the lower member 154. In the aligned position, an alignment sensor 156 in the upper member is aligned with an alignment indicator 158 on the lower member. In the preferred embodiment, the sensor 156 is a Microswitch P/N 2SSP hall effect sensor. If an object strikes the lower member 154 and moves the sensor 156 and indicator 158 out of alignment, a signal indicating a collision is sent to the controller 120. Preferably, there is some tolerance between the members 152 and 154 so that slight contact will not trigger the collision signal.

In response to a collision signal, the controller 120 determines whether the swing arm 40 is in an extended position. If so, the controller 120 activates the vertical actuator 31 to slowly raise the transport assembly 36, and stops the applicator. The controller 120 may also stop the conveyor 14 or activate an alarm which indicates a collision. If the swing arm 40 is not in the extended position, the controller 120 stops the system. Once the condition which caused the collision is corrected, the applicator may be reset either by hand or automatically. The automatic reset may be used in the situations where the transport assembly 36 is raised. A device, positioned at the top of the column 20, moves the upper and lower members 152 and 154, and thereby alignment sensor 156 and indicator 158, back into alignment. When the sensor 156 and indicator 158 are realigned, a signal is sent to the controller 120 to restart the applicator.

Figure 4:
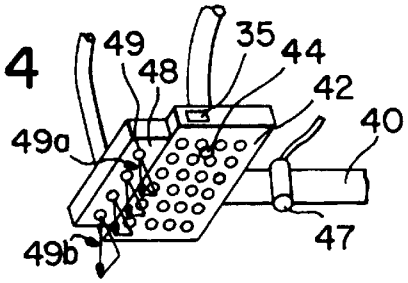
FIG. 4 is a perspective view of the vacuum/blow plate and air knife assembly.

As shown in FIG. 4, an air knife 48 is affixed to the end of the vacuum/blow plate 42. A blast of high pressure air is blown through apertures 49 of the air knife 48 after the label 15 is on the article surface to smooth the label 15 onto the surface and ensure that the label is firmly affixed. In the preferred embodiment, shown in FIG. 4 the air knife 48 has four apertures 49. The three outboard apertures 49 are set at a 20° angle 49*a* from vertical in the direction of travel of the article 12. The remaining inboard aperture 49 is set at a 20° angle toward the side of the conveyor.

Referring to FIGS. 2 and 4, a plurality of sensors, described below, are mounted on the carriage 32 and the transport arm assembly 36. Look down sensor 47 is mounted adjacent to the vacuum/blow plate 42 to detect the presence of the article surface to be labeled. Position sensors 45 are positioned adjacent to the rotary actuator 38 to detect whether the linear actuator 38 is in the extended or retracted position.

Figure 3:
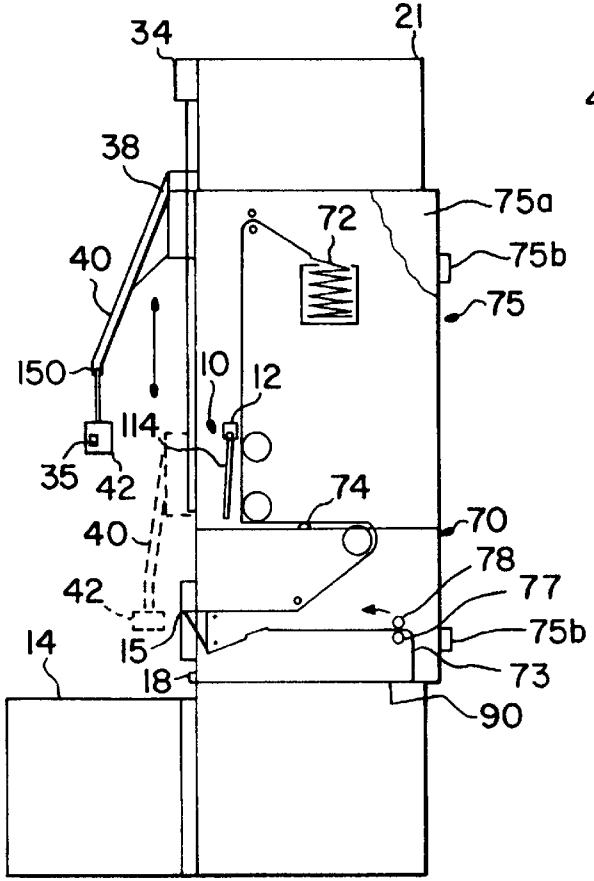
FIG. 3 is a side view of the preferred embodiment.

Referring to FIG. 3, enclosure 75 encompasses the printer 70, the label stock supply 72, the disposal assembly 110 and the take-up system. In the preferred embodiment, the printer 70, the label stock supply 72, and the take-up system are mounted on the enclosure door panel 75*a* which is removably mounted on the enclosure 75. Preferably, door panels 75*a* having different printers 70 can be interchanged to change the system printer for different applications. Additionally, a replacement panel 75*a*', with a label supply pre-fed through a printer similar to that of the existing panel 75*a,* can be kept on hand to replace the existing panel 75*a* when the label supply runs out. This reduces down time since an applicator does not have to remain shutdown for a substantial time while the label supply is re-fed. The pre-fed replacement door panel 75*a* can be used most efficiently in an operation having multiple labeling systems. In such an operation, one extra panel allows the panels to be rotated, with a pre-fed panel always available.

The enclosure 75 is slidably mounted on the column 20 to allow adjustment of the enclosure to a median height for articles on the conveyor. Label ready sensor 71 is mounted on the printer 70 adjacent to the label feed position of the printer 70. The home position sensor 80 detects the presence of the carriage 32 and signals controller 120 when the label transport assembly 36 is in the home position. A blow tube 76 is located beneath the label feed position to provide an air blast to assist in the transfer of the label 15 from the backing 73 to the vacuum/blow plate 42 on the transport assembly 36. When the label ready sensor 71 detects the absence of a label 15, it is presumed that the label 15 was picked up by the transport assembly 36.

Figure 5:
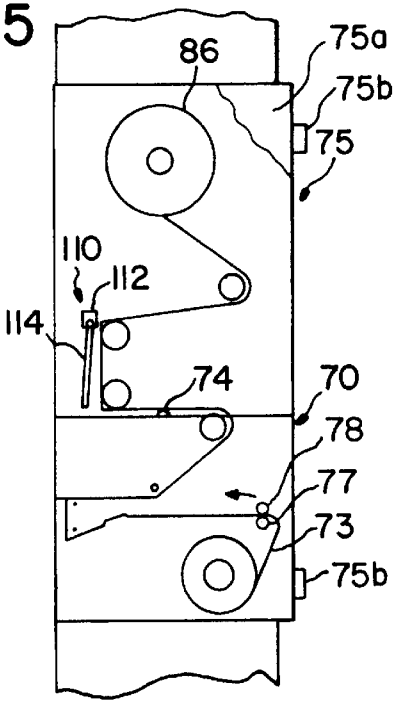
FIG. 5 is a side view of an alternative embodiment of the invention.

An electronic rotary cutter assembly 90 cuts down the continuous strip of backing 73 into small pieces 83 for easy disposal. As shown in FIGS. 5, the backing paper may also be spooled up into an auxiliary reel as known in the art. In either case, it may be desirable to provide a tensioning assembly in the path of the backing 73 to maintain the label supply at a constant tension for reliable peeling. As shown in FIGS. 3 and 5, the tensioning assembly comprises a drive roller 77 and a moveable contact roller 78. The label supply is fed from a supply roll 86 which has a constant minimum tension. The label supply is fed through the printer and then the backing 73 is fed around the drive roller 77. The contact roller 78 is then moved to a position where the backing 73 is pinched between the two rollers 77 and 78. The drive roller 77 is rotated at a constant speed and provides a sufficient pull to overcome the minimum tension in the supply roll 86. As a result of the constant speed, the label supply is maintained at a constant tension as it passes through the printer 71. This is desirable in the configuration shown in FIG. 3 since it is difficult for the rotary cutter assembly 90 to maintain tension in the label supply. With respect to the embodiment shown in FIG. 5, it is desirable to maintain a constant tension through the printer 71 since the tension provided by the take-up spool generally changes as the diameter of the take-up spool increases.

A belt position sensor 82, shown in FIGS. 1 and 2, is mounted adjacent to the conveyor belt and signals the conveyor belt position to the controller 120 to allow the speed of the belt to be determined. Light curtain 16 which detects the article profile is attached to the conveyor. Position sensors and light curtains are known in the art. An article detection sensor 18 is located in direct alignment with the vacuum/blow plate 42 to detect when the front of the article 12 reaches this position.

As shown in FIG. 3, fan fold label stock 72 is provided to the label printer 70. In the preferred embodiment, the supply of labels is stored above the printer 70. However, the label supply may be located in any position. The backing paper 73 is discharged from the printer as the label 15 is printed. Sensor 74 detects when the label supply is about to run out and signals the controller 120 to stop advancing the label stock 72 before it passes sensor 74. A new supply can then be spliced onto the existing stock without the need to rethread the label stock 73 through the printer 70. In an alternative embodiment of the invention as shown FIG. 5, the label stock 72 is provided on a spool 86.

Referring again to FIG. 3, a label disposal assembly 110 is mounted at a position directly above the printer 70. The label disposal assembly 110 is comprised of a fluid actuator 112 with an attached plate 114. When a label 15 cannot be applied, the fluid actuator 112 is actuated to swing the plate 114 out into the path of the retracted label transport arm 40, and the label 15 is applied to the plate 114.

Having provided a detailed description of the structure of the label applicator 1, a description of its operation follows with reference to FIG. 1. The printer applicator 1 is placed adjacent to a conveyor belt 14 and the conveyor belt speed sensor 82 is attached to the belt section. The height of the enclosure 75 is adjusted so that the label feed position is set to an expected median article height for the conveyor 14. The controller 120 initializes the minimum height above the conveyor 14 for the vertical actuator 31 and locates the home or label pick-up position. The home position is identified when optical sensor 80 detects the presence of the vertical carriage 46 as the actuator 31 moves the label transport assembly 36 up and down. The bottom travel limit for the vertical actuator 31 is set to approximately ⅜" above the conveyor surface.

As the article 12 passes the light curtain 16, height data is collected by the light curtain 16 and signaled to the controller 120. The conveyor belt speed is also signaled to the controller 120 by the belt speed sensor 82. Label data for the article 12 is provided to the controller 120. The controller 120 directs the printer 70 to print the label for the article 12. The vertical actuator 31 positions the vacuum/blow plate 42 above the home or label feed position. The position of the vacuum/blow plate 42 is verified by the home position sensor 80. When the label 15 is complete, it is presented at the label feed position. The controller 120 activates a vacuum through the vacuum/blow plate 42. A blast of air from air pressure assist tube 76 blows the label 15 up towards the vacuum/blow plate 42. The label ready sensor 71 senses that the label 15 is removed. If necessary, the vertical actuator 31 moves the transport assembly 36 to the label 15 to pick it up.

The controller 120 then signals the vertical actuator 31 to move up or down, based on the height data collected from the light curtain 16, to the label application height for the article 12. The article detect sensor 18 signals the controller 120 when the article 12 passes directly in front of the vacuum/blow plate 42. The look down sensor 47 then signals the controller 120 to confirm that the article surface 12 is directly below and in close proximity to the vacuum/blow plate 42. The controller 120 waits for the label application point to pass under the vacuum/blow plate 42 and, when the point is presented, reverses the vacuum to a high pressure blast of air to apply the label 15 to the article 12. The label is then smoothed down onto the article surface with a blast of air from the air knife 48 to ensure adherence. The process is then repeated for the next article. The transport arm assembly 36 can be programmed to reach over obstructions of limited height and width such as conveyer package guides.

As described above, it is preferable to have enough tolerance in the break away joint 150 so that an object striking the transport arm assembly with a minimal force will pass without causing a collision signal. However, if an object strikes the transport arm assembly 36 with sufficient force, the lower member 154 of the transport arm assembly 36 will pivot and the alignment sensor 156 will signal a collision to the controller 120. As described above, the transport arm 36 will then move upward and the applicator stopped, or alternatively, the system will be stopped without moving the transport arm 36. The system can then be either manually reset or automatically reset, as described above, to continue labeling packages.

If a label 15 cannot be applied, the controller 120 directs the linear actuator 38 to retract the swing arm 40. The label 15 is then carried by the vertical actuator 31 to the label disposal assembly 110. If the label transport assembly 36 is above the disposal assembly 110, the controller 120 simultaneously actuates the actuator 112 to swing the plate 114 into position as the transport arm assembly 36 is retracted by rotary actuator 38 and moved down into a position above the plate 114. The label is then disposed of by blowing it onto the plate 114. If the label transport arm assembly 36 is below the disposal assembly 110, the transport arm assembly 36 is raised to the height of the disposal plate 114 as it is being moved into position, and the rotary actuator 38 is retracted prior to blowing the label onto the plate 114.

In the preferred embodiment, the system controller 120 is an 80386 processor.

While the present invention has been described in terms of the preferred embodiments, the advantages of utilizing an applicator which does not vertically obstruct the article path as well as a height adjustable printer will be recognized by those skilled. It will be understood that the invention is not limited to the preferred embodiments, and that changes may be made herein without departing from the scope of the invention.

We claim:

1. A label applicator of a type that applies a label to a conveyed article by retaining the label on a transport means and moving the transport means to a label applying position where the label is applied to the article by a non-contact application means, the applicator characterized by:

the transport means having first and second members connected by a breakaway joint whereby the connected members generally move as a rigid unit with the members in a given alignment relative to one another, but the members pivot relative to each other when one member is struck by a conveyed article, and one of the members includes a sensor and the other member includes an indicator and the sensor and indicator are in alignment when the members are in the given alignment and move out of alignment when the members pivot relative to each other.

2. The label applicator of claim 1 wherein a signal is emitted when the sensor and indicator are out of alignment.

3. The label applicator of claim 2 wherein the transport means is moved away from the label applying position upon emission of the signal.

4. A label applicator of a type that applies a label to a conveyed article by retaining the label on a transport means and moving the transport means to a label applying position where the label is applied to the article, the applicator characterized by:

the transport means having first and second members connected by a breakaway joint whereby the connected members generally move as a rigid unit with the members in a label applying alignment, but the members pivot relative to each other into a non-label applying alignment when one member is struck by a conveyed article, and one of the members includes a sensor and the other member includes an indicator and the sensor and indicator are in alignment when the members are in the given alignment and move out of alignment when the members pivot relative to each other.

5. The label applicator of claim 4 wherein a signal is emitted when the sensor and indicator are out of alignment.

6. The label applicator of claim 5 wherein the transport means is moved away from the label applying position upon emission of the signal.

* * * * *